US010024190B1

(12) United States Patent
Memmen

(10) Patent No.: US 10,024,190 B1
(45) Date of Patent: Jul. 17, 2018

(54) APPARATUS AND PROCESS FOR FORMING AN AIR COOLED TURBINE AIRFOIL WITH A COOLING AIR CHANNEL AND DISCHARGE SLOT IN A THIN WALL

(71) Applicant: Robert L Memmen, Stuart, FL (US)

(72) Inventor: Robert L Memmen, Stuart, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 15/143,666

(22) Filed: May 2, 2016

Related U.S. Application Data

(60) Provisional application No. 62/249,557, filed on Nov. 2, 2015.

(51) Int. Cl.
*F01D 25/12* (2006.01)
*F01D 9/02* (2006.01)
*F01D 5/18* (2006.01)

(52) U.S. Cl.
CPC ..... *F01D 25/12* (2013.01); *F01D 9/02* (2013.01); *F01D 5/187* (2013.01); *F05D 2220/30* (2013.01); *F05D 2230/21* (2013.01); *F05D 2260/201* (2013.01); *F05D 2300/20* (2013.01)

(58) Field of Classification Search
CPC ... B23P 15/006; B23P 15/04; Y10T 29/49321
See application file for complete search history.

(56) References Cited

U.S. PATENT DOCUMENTS

| | | | | |
|---|---|---|---|---|
| 5,392,515 | A * | 2/1995 | Auxier | B23P 15/04 29/463 |
| 7,325,587 | B2 * | 2/2008 | Memmen | B22C 7/02 164/361 |
| 8,066,052 | B2 * | 11/2011 | Blair | B22C 7/02 164/369 |
| 8,113,780 | B2 * | 2/2012 | Cherolis | B22C 7/02 416/97 R |
| 2005/0087319 | A1 * | 4/2005 | Beals | B22C 7/02 164/45 |
| 2015/0377038 | A1 * | 12/2015 | Alpan | B22C 7/02 415/200 |

* cited by examiner

*Primary Examiner* — Jason Shanske
*Assistant Examiner* — Cameron Corday
(74) *Attorney, Agent, or Firm* — John Ryznic

(57) ABSTRACT

A ceramic core used to cast and cooling circuit in a thin wall turbine airfoil, where the ceramic core includes a row of metering and impingement forming pieces that discharge into a radial plenum, followed by a row of pedestals and a row of diffusion channels that then flow into a single discharge slot. The ceramic core has bumpers of both sides to position the core in a wax mold. The metering and impingement holes are offset from the cooling passage in the airfoil wall so that impingement of the hot surface of the wall occurs.

8 Claims, 5 Drawing Sheets

APPARATUS AND PROCESS FOR FORMING AN AIR COOLED TURBINE AIRFOIL WITH A COOLING AIR CHANNEL AND DISCHARGE SLOT IN A THIN WALL

CROSS-REFERENCE TO RELATED APPLICATIONS

This application claims the benefit to U.S. Provisional Application 62/249,557 filed Nov. 2, 2015 and entitled APPARATUS AND PROCESS FOR FORMING AN AIR COOLED TURBINE AIRFOIL WITH A COOLING AIR CHANNEL AND DISCHARGE SLOT IN A THIN WALL.

Apparatus and process for forming an air cooled turbine airfoil with a cooling air channel and discharge slot in a thin wall.

GOVERNMENT LICENSE RIGHTS

None.

BACKGROUND OF THE INVENTION

Field of the Invention

The present invention relates generally to an air cooled turbine airfoil, and more specifically to a cooling channel and discharge slot in a thin wall of an airfoil.

Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

First stage turbine airfoils require the most cooling because these airfoils (rotor blades and stator vanes) are exposed to the highest gas stream temperature. Critical areas of the stator vanes include the leading edge region and the trailing edge region. The trailing edge region is especially difficult for designing a cooling circuit because the airfoil is very thin and the walls of the airfoil are thin.

BRIEF SUMMARY OF THE INVENTION

An airfoil thin wall exposed to a high gas stream temperature includes a cooling air channel with a shallow angle discharge slot to provide impingement cooling and convection cooling for a cast thin wall of the airfoil. The thin wall cooling channels are formed using a ceramic core with a number of metering and impingement forming pieces and positioning bumpers that position the ceramic core between two walls for the casting process. The metering and impingement forming pieces have a rounded top that fits within concave sections of one of the two walls that function to position the ceramic core as well as provide for any flashing to form that can then be easily removed by machining after the airfoil and the cooling channels have been formed.

DETAILED DESCRIPTION OF THE INVENTION

The present invention is an apparatus and a process of forming a cooling air channel and discharge slot in a thin wall of an air cooled turbine airfoil such as a stator vane or a rotor blade. The cooling air channel with the discharge slot can also be used in a thin wall that is exposed to a high gas stream temperature that requires cooling such as a combustor liner or a blade outer air seal (BOAS). The present invention includes a ceramic core with structure to form a row of impingement cooling holes for supply of cooling air, a plenum, a wall cooling channel with a row of pedestals and a row of diffusion channels, and a discharge slot that form the cooling air flow surfaces, and a number of bumpers that position the ceramic core within a tool used to form the airfoil wall with the cooling channel and discharge slot of the present invention.

Figure 1:
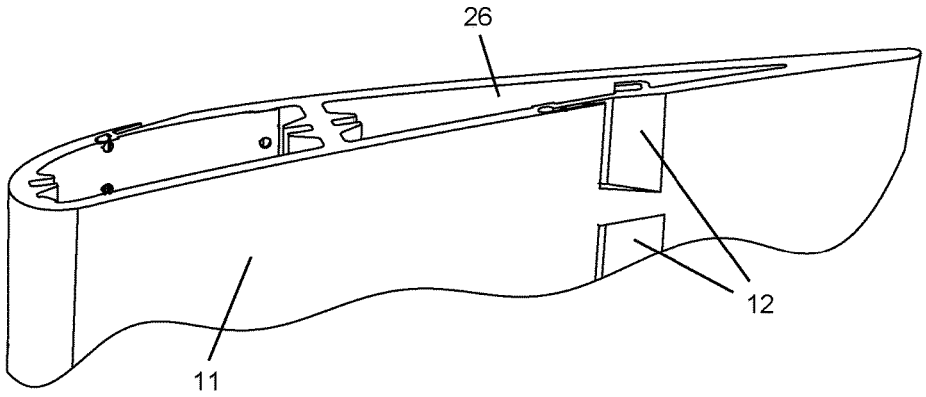
FIG. 1 shows a schematic view of an end of an airfoil with the airfoil wall cooling channel with discharge slot of the present invention.

FIG. 1 shows an airfoil (such as a turbine stator vane or a rotor blade) 11 with a row of discharge slots 12 that open onto a surface of the airfoil. Cooling channels formed within the thin airfoil wall flow into the discharge slots 12 with cooling air supplied from a channel formed within the airfoil such as radial channel 26. The airfoil wall cooling channels and discharge slots of the present invention can be located along any section of the airfoil wall from the leading edge region to the trailing edge region.

Figure 2:
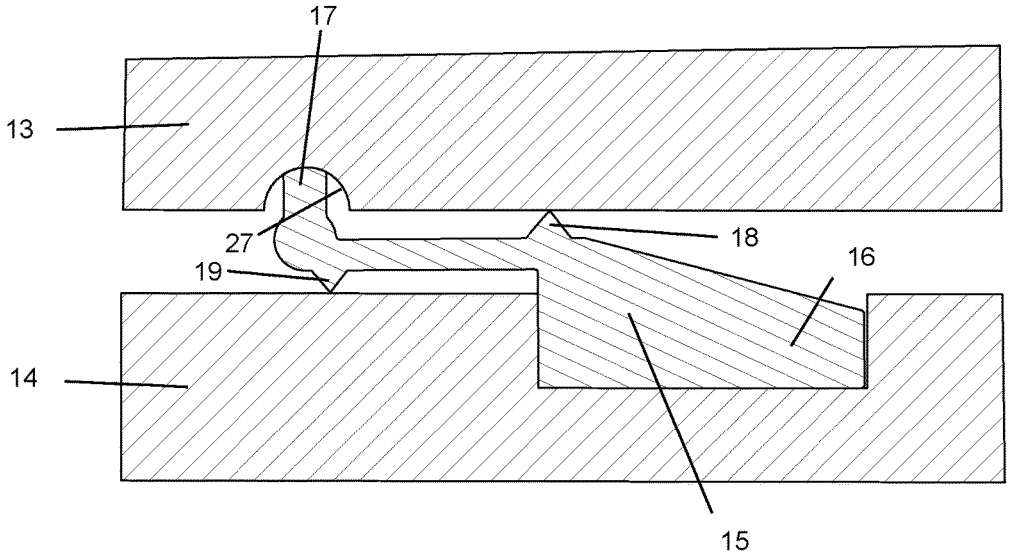
FIG. 2 is a cross section top view of a ceramic core in position to form the airfoil wall cooling channel and discharge slot of the present invention.

FIG. 2 shows one ceramic core 15 of the present invention positioned between a wall of a core 13 and a wall of a wax tool 14 with the open space used to form the airfoil wall. The ceramic core 15 includes positioning bumpers 18 and 19 to position the ceramic core 15 within the space to prevent shifting during the process in which a wax is used to fill the open space. A row of cylinders 17 and the discharge slot forming piece (shell lock extension) 16 also position the ceramic core 15 within the space between the core wall 13 and the wax tool wall 14. In one embodiment of the present invention, a row of separate ceramic cores 15 are used to form a row of discharge slots 12 on the airfoil. In another embodiment, one long ceramic core piece can be used to form the entire row of discharge slots 12 on the airfoil wall along with the cooling air channels that discharge into the discharge slots 12. Separate ceramic cores 15 are useful when ribs are to be formed in the airfoil wall between adjacent discharge slots 12 in order to stiffen the airfoil wall.

Figure 5:
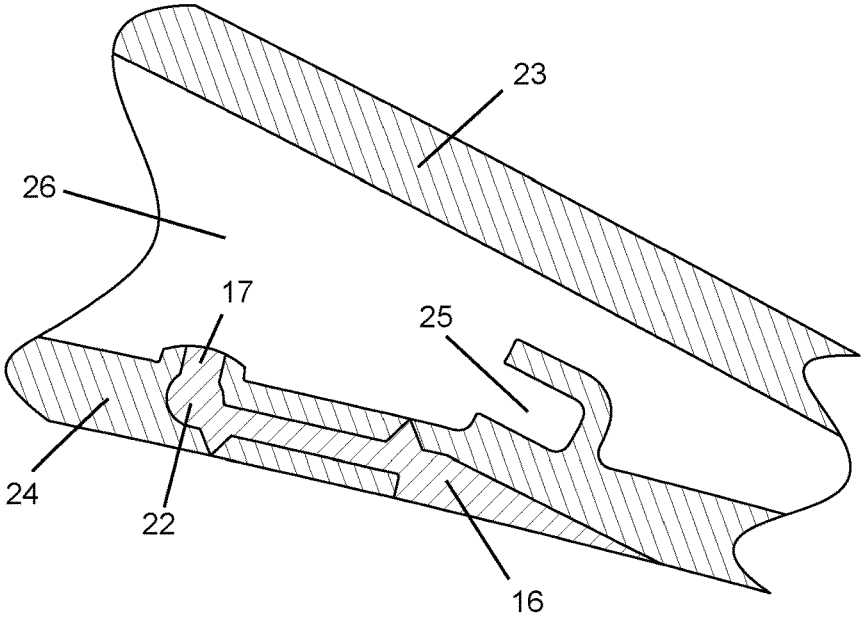
FIG. 5 shows the ceramic core formed within the airfoil wall of the present invention.
Figure 6:
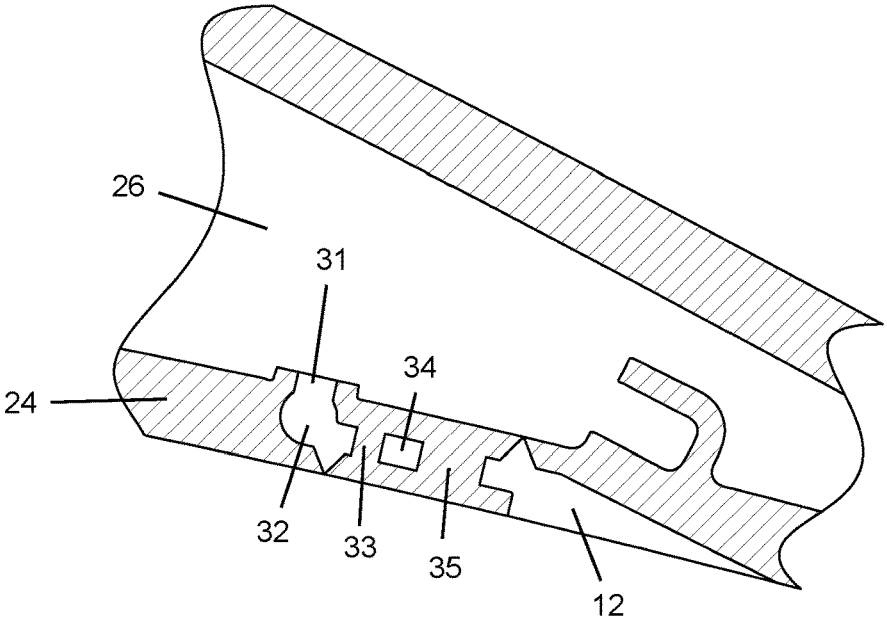
FIG. 6 shows the airfoil wall with the ceramic core leached away and leaving the cooling channel and discharge slot of the present invention.

The row of cylinders 17 that are the metering and impingement forming pieces of the ceramic core 15 have rounded ends that fit within concave sections 27 of the wall of the core 13. This functions to secure the ceramic core 15 in place between the core wall 13 and the wax tool 14 (opposite to the bumper 19) but also to allow for any flashing to occur when the airfoil and its cooling circuit is cast. The cylinders 17 and the bumpers 19 position this end of the ceramic core 15 within the wall 13 and tool 14. Any flashing will form in the concave section 27 and can be easily removed by machining after the airfoil is cast. FIG. 5 shows the ceramic core in the cast airfoil wall 24 and FIG. 6 shows the ceramic core leached away with the cooling circuit remaining and the metering and impingement hole machined to a flat surface with any flashing removed.

Figure 3:
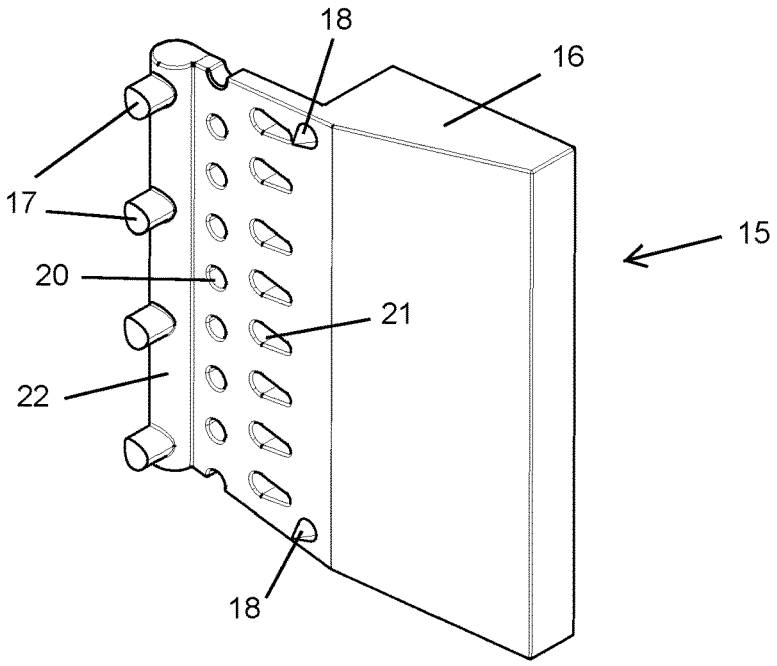
FIG. 3 shows a schematic view from one side of the ceramic core used to form the cooling channel and discharge slot of the present invention.

FIG. 3 shows one ceramic core 15 from an inner side with a row of cylindrical ends 17 extending from a plenum forming piece 22, a cooling channel forming piece with a row of pedestal forming pieces 20 and a row of diffusion channel forming pieces 21, and a discharge slot forming piece 16. Two bumpers 18 are used on this side of the ceramic core 15 that position the ceramic core 15 in the space formed between the two walls 13 and 14.

Figure 4:
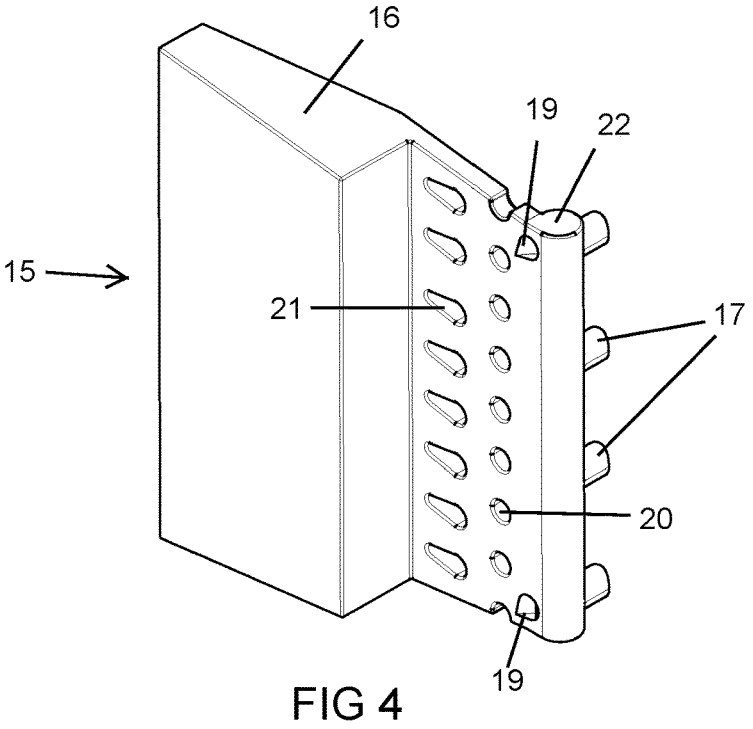
FIG. 4 shows a schematic view from the opposite side of the ceramic core of FIG. 3.

FIG. 4 shows the ceramic core piece 15 from the other side of FIG. 3, with two more bumpers 19 on this side to position the ceramic core between the two walls 13 and 14.

FIG. 5 shows the ceramic core 15 formed between an airfoil wall 24 with the cylindrical piece 17 and the plenum 22 and the discharge slot forming piece 16. The airfoil includes a suction side wall 23 and a pressure side wall 24 with a cooling air supply channel 26. In this particular airfoil, a slot 25 is used to position a flexible seal that connects to a second slot formed in an impingement insert.

FIG. 6 shows the airfoil with the cooling channel and discharge slot formed within the airfoil wall 24 on the pressure side wall. A row of inlet metering and impingement holes 31 are formed by the cylindrical pieces 17. The plenum 32 extends the spanwise length of the ceramic core. The airfoil wall cooling channel 34 includes a row of pedestals 33 and a row of diffusion chambers 35 that discharge into the discharge slot 12. The cooling air from the supply channel 26 flows through the row of inlet metering holes 31 and impingement against the airfoil wall in the plenum chamber 32. The spent impingement cooling air then flows along the airfoil wall channel 34 around the row of pedestals 33 and then through ribs that form the row of diffusion chambers 35 and then into the discharge slot 12 that opens onto the airfoil outer surface.

Figure 7:
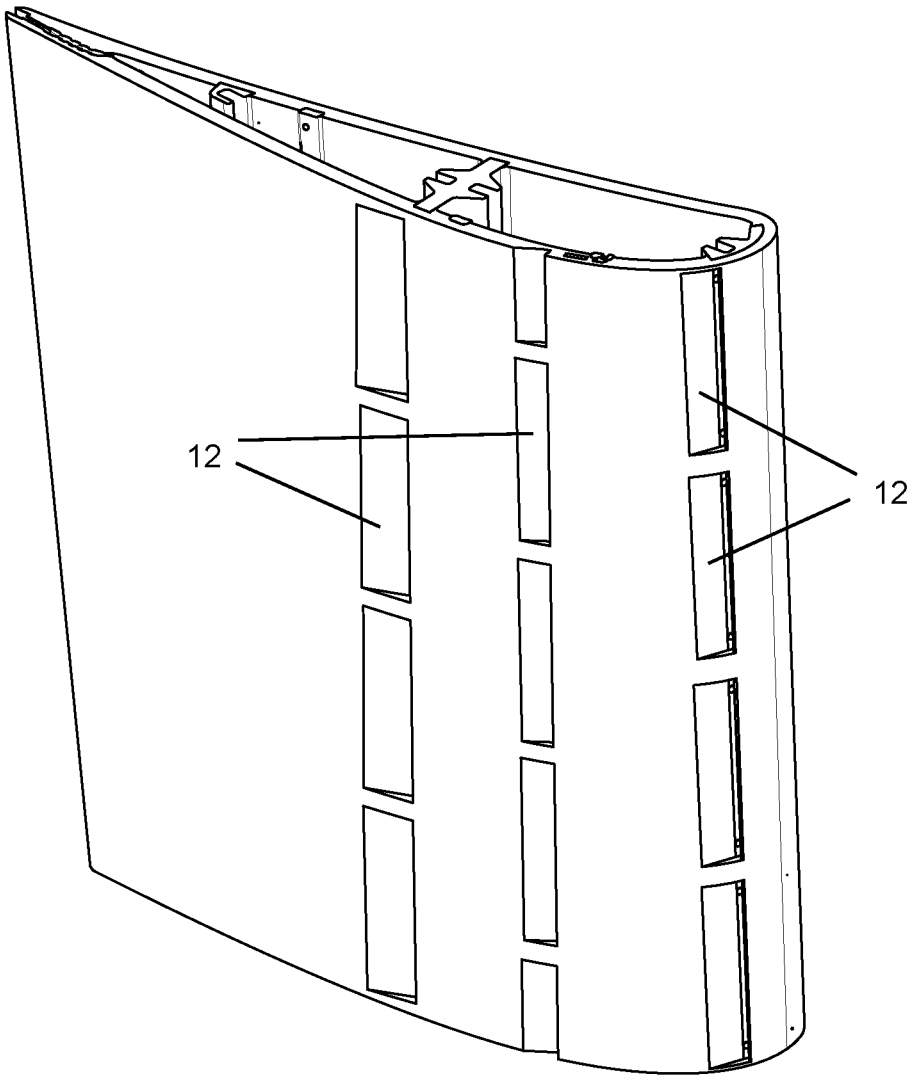
FIG. 7 shows a schematic view of a suction side of the airfoil with three rows of discharge slots of the present invention.
Figure 8:
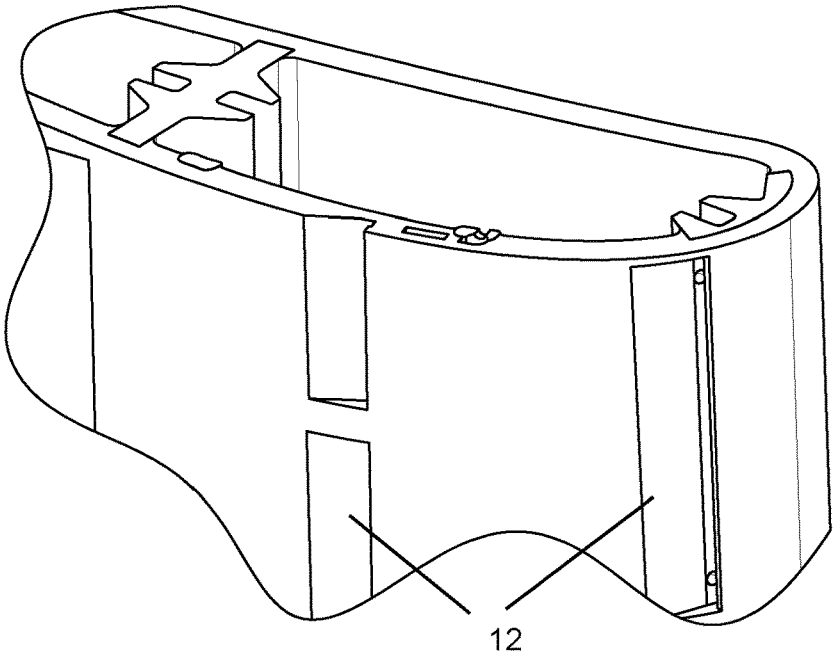
FIG. 8 shows a close-up view of the leasing edge region on the suction side of the airfoil of FIG. 7 with two rows of discharge slots.
Figure 9:
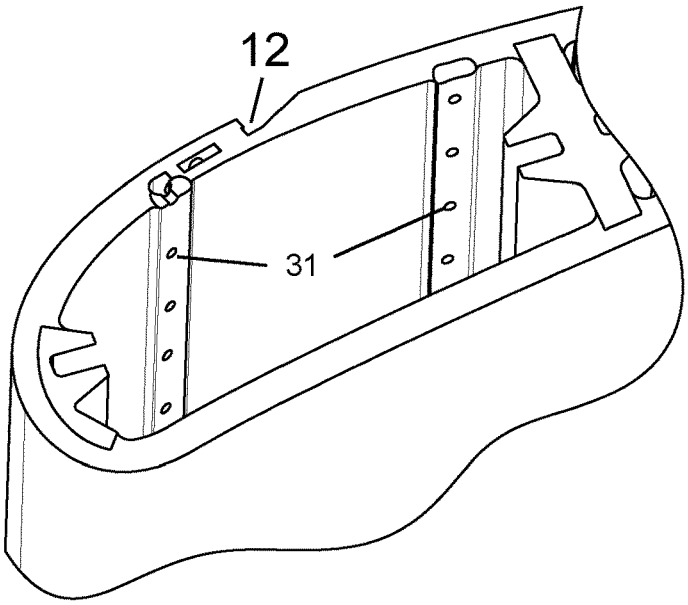
FIG. 9 shows a close-up view of ab inside of the suction side wall in the leading edge region of the airfoil of FIG. 7.

FIG. 7 shows the air cooled turbine stator vane of the present invention from a suction side in which three rows of discharge slots 12 are used in which each discharge slot 12 is formed using the same ceramic core of FIGS. 3 and 4. FIG. 8 shows a detailed view of a section of the suction side in FIG. 7 with two of the rows of discharge slots 12. FIG. 9 shows an inside view of the suction side wall with two rows of the metering and impingement holes 31 and one row of the discharge slots 12. Thus, with the ceramic cores of FIGS. 3 and 4, the entire airfoil can be cast with the cooling passages in a thin wall airfoil.

The ceramic core 15 of the present invention allows for a cooling air channel to be formed by casting within a thin wall of an airfoil. Also, the ceramic core 15 allows for a discharge slot 12 to be formed in an airfoil wall with a shallow discharge angle in a cast airfoil. The individual ceramic cores 15 form pockets inside the airfoil wall casting to augment cooling of the part. These pockets allow the cooling air to be in close proximity to the airfoil surface to provide for a better shielding of the structural support from the high gas path temperatures. The cooling air exits the airfoil wall through shallow angle discharge slots 12 which can be set to low angles in order to provide good cooling film adhesion to the airfoil external surface. Having the metering holes at the inlet end in the ceramic core 15 formed by the impingement hole forming pieces 17 and not at the outlet of the cooling passage eliminates the need to mask any part prior to applying a TBC to the airfoil surface. Metering holes are small and would require a mask if on the outlet end of the passage. Masking is expensive and could result in the small metering holes becoming plugged or restricted in the flow. Improper cooling of the section of the airfoil with a plugged or restricted hole would be the result. Thus, providing for the metering at the inlet end would have these results as well.

The ceramic cores 15 are inserted into a wax pattern forming tool prior to injection of the wax. The cylindrical feed tube ends 17, bumpers 18 and 19 and shell support features 16 locate the ceramic cores in the tool. The wax traps and encapsulates the ceramic core 15. The cylindrical ends 17 of the feed tubes and the shell lock are exposed so that they may interface with the ceramic core and shell respectively. The ceramic core 15 is held in the mold after de-waxing by the core interface with the cylindrical portion 17 of the feed tubes and the opposite bumpers 19 and at the other end by the shell lock 16 and the opposed bumpers 18. After casting a metal of the airfoil, a metal half-round encapsulates the feed tubes of the cylindrical feed tubes 17 that form the inlet impingement holes of the cooling channel. The ceramic core 15 cannot be pressed tight enough to the cores 13 and 14 to prevent flash-over or finning of the metal between the ends of the cylindrical portions 17 and the inner surface of the concave portions in the core wall 13. Thus, a thin metal flash is left when the airfoil wall is cast around the ceramic core 15 as seen in FIG. 5 represented by the convex shaped end of the cylindrical section 17. The thin metal flash will occur at the outside of the cylindrical piece 17 ends. A machining process such as an EDM plunge cut will be used to remove the flash by removing most of the half rounded ends and all of the residual metal flash resulting in the flat surfaces as seen in FIG. 6. This also formed the impingement holes 31 that connect the cooling air supply channel 26 to the plenum 32.

I claim the following:

1. A ceramic core for use in forming a cooling passage in a thin wall of an air cooled turbine airfoil, the ceramic core comprising:

a radial extending plenum forming section;

a plurality of metering and impingement forming pieces connected to the radial extending plenum;

a plurality of pedestal forming pieces downstream in a cooling flow direction from the plenum forming section;

a plurality of diffusion forming pieces downstream from the plurality of pedestal forming pieces;

a discharge forming slot section downstream from the plurality of diffusion forming pieces;

a plurality of bumpers to position the ceramic core within a wax mold;

the ceramic core forms a cooling passage in a thin wall airfoil with multiple metering and impingement holes followed by pedestal cooling and diffusion and then discharge from a single slot; and, the metering and impingement forming pieces are offset at 90 degrees from the pedestal and diffusion forming pieces such that impingement will occur against an inside surface of the thin wall formed by the ceramic core.

2. The ceramic core of claim 1, and further comprising:

the metering and impingement forming pieces each have convex shaped ends.

3. The ceramic core of claim 1, and further comprising:

a positioning bumper on the ceramic core on an opposite side from the metering and impingement forming piece that functions to position the ceramic core between two walls.

4. An air cooled turbine stator vane comprising:

a thin airfoil wall with one side exposed to a hot gas stream and an opposite side forming a cooling air supply cavity;

a row of metering and impingement holes formed in the thin wall and opening into the cooling air supply cavity, the row of metering and impingement holes directing impingement cooling air against an inside surface of the thin airfoil wall;

a radial extending plenum downstream from the metering and impingement holes;

a row of pedestals in a cooling air passage formed within the thin wall and downstream from the metering and impingement holes;

a row of diffusion channels downstream from the row of pedestals; and, a single cooling air discharge slot downstream from the diffusion channels.

5. The air cooled turbine stator vane of claim 4, and further comprising:

the row of metering and impingement holes open into the radial extending plenum such that impingement cooling of the side of the airfoil exposed to the hot gas stream occurs.

6. The air cooled turbine stator vane of claim 4, and further comprising:

the metering and impingement holes and the plenum and the pedestals and the diffusion channels and the discharge slot are cast within the thin airfoil wall by a ceramic core.

7. The air cooled turbine stator vane of claim 4, and further comprising:

the thin airfoil wall includes a row of discharge slots; and, each discharge slot is connected to a cooling channel having metering and impingement holes followed by a plenum and pedestals and diffusion channels that flow into the discharge slot.

8. An air cooled turbine airfoil comprising:

an airfoil wall with one side exposed to a hot gas stream and an opposite side forming a cooling air supply cavity;

a row of metering and impingement holes formed in the airfoil wall and opening into the cooling air supply cavity, the row of metering and impingement holes directing impingement cooling air against an inside surface of the thin airfoil wall;

a radial extending plenum downstream from the metering and impingement holes;

a row of pedestals in a cooling air passage formed within the airfoil wall and downstream from the metering and impingement holes;

a row of diffusion channels downstream from the row of pedestals;

a single cooling air discharge slot downstream from the diffusion channels; and, a flow passage from the diffusion channels into the discharge slot produces no additional metering of the flow such that a coat down of a TBC can be applied without masking that will not produce an additional metering of the cooling air flowing into the discharge slot.

* * * * *